US005198101A

United States Patent [19]

Kalback

[11] Patent Number: 5,198,101

[45] Date of Patent: Mar. 30, 1993

[54] PROCESS FOR THE PRODUCTION OF MESOPHASE PITCH

[75] Inventor: Walter M. Kalback, Ponca City, Okla.

[73] Assignee: Conoco Inc., Ponca City, Okla.

[21] Appl. No.: 806,683

[22] Filed: Dec. 13, 1991

[51] Int. Cl.[5] ..... C10C 3/00

[52] U.S. Cl. ..... 208/39; 208/44; 208/22

[58] Field of Search ..... 208/39, 40

[56] References Cited

U.S. PATENT DOCUMENTS

| | | | |
|---|---|---|---|
| 3,970,690 | 7/1976 | Suzuki et al. | 208/40 |
| 3,974,264 | 8/1976 | McHenry | 423/447.4 |
| 3,976,729 | 8/1976 | Lewis et al. | 264/29 |
| 4,017,327 | 4/1977 | Lewis et al. | 423/447.4 |
| 4,021,356 | 5/1977 | Kudchadker et al. | 208/44 |
| 4,026,788 | 5/1977 | McHenry | 264/DIG. 19 |
| 4,096,056 | 6/1978 | Haywood et al. | 208/4 |
| 4,202,755 | 5/1980 | Spiegelman et al. | 208/5 |
| 4,209,500 | 6/1980 | Chwastiak . | |
| 4,303,631 | 12/1981 | Lewis et al. | 208/39 |
| 4,460,454 | 7/1984 | Iijima ert al. | 208/40 |
| 4,460,455 | 7/1984 | Moriya et al. | 208/40 |
| 4,469,585 | 9/1984 | Cukier et al. | 208/39 |
| 4,554,148 | 11/1985 | Gomi et al. | 208/40 |
| 4,600,496 | 7/1986 | Cheng et al. | 208/44 |
| 4,664,774 | 5/1987 | Chu et al. | 208/6 |
| 4,704,333 | 11/1987 | Elkins et al. | 208/22 |

FOREIGN PATENT DOCUMENTS

| | | |
|---|---|---|
| 2221707 | 11/1972 | Fed. Rep. of Germany . |
| 65090 | 2/1986 | Japan . |

*Primary Examiner*—Helane E. Myers

[57] ABSTRACT

An improved process for producing an anisotropic pitch product suitable for carbon fiber manufacture. A metal alkylaryl sulfonate is combined with a carbonaceous feedstock substantially free of mesophase pitch, and the combination is heated for a period of time at an elevated temperature while passing a non-oxidative sparging gas such as nitrogen through the feedstock. The process is carried out for a sufficient period of time to produce an anisotropic pitch having from 50 to 100 percent by volume mesophase which is suitable for producing good quality carbon fibers.

In one aspect of the invention, an oxidatively reactive gas is used as the sparging gas.

25 Claims, No Drawings

PROCESS FOR THE PRODUCTION OF MESOPHASE PITCH

BACKGROUND OF THE INVENTION

Generally speaking, ordinary pitch has an amorphous structure. Such pitch is used as a binder in the manufacture of baked carbon bodies such as carbon electrodes. Carbon electrodes are used in the manufacture of steel and in the manufacture of aluminum.

When amorphous pitch is heated to temperatures of at least about 350° C. in an inert gas atmosphere, the molecules of pitch become oriented to give rise to a kind of optically ordered liquid crystal within the pitch. This liquid crystal is called a mesophase. Mesophase pitch is used in the manufacture of high quality carbon fibers. Amorphous pitch is not suitable for use in the carbon fiber process.

A number of different processes have been used for the conversion of various aromatic hydrocarbon feedstocks to mesophase pitch. The process of the invention is an improvement over these prior art processes.

PRIOR ART

In recent years, extensive patent literature has evolved concerning the conversion of carbonaceous pitch feed material into a mesophase-containing pitch which is suitable for the manufacture of carbon fibers having desirable modulus of elasticity, tensile strength, and elongation characteristics.

U.S. Pat. No. 4,209,500 (issued to Chwastiak) is directed to the production of a high mesophase content pitch that can be employed in the manufacture of carbon fibers. This patent is one of a series of patents pertaining to a process for producing mesophase pitches suitable for carbon fiber production. Each of these patents broadly involves heat treating or heat soaking the carbonaceous feed while agitating and/or passing an inert gas therethrough so as to produce a more suitable pitch product for the manufacture of carbon fibers.

As set forth in the Chwastiak patent, earlier U.S. Pat. Nos. 3,976,729 and 4,017,327 (issued to Lewis et. al.) involve agitating the carbonaceous starting material during the heat treatment. The use of an inert sparge gas during heat treatment is found in U.S. Pat. Nos. 3,974,264 and 4,026,788 (issued to McHenry). Stirring or agitating the starting material while sparging with an inert gas is also disclosed in the McHenry patents.

U.S. Pat. No. 4,096,056 (issued to Haywood et al) discloses producing a pitch (from petroleum), having a softening point of 135° C., which would define an isotropic pitch. The highest processing temperature is below the normal sparging temperature. The patent describes an oxygen treatment in a two-step process.

U.S. Pat. No. 4,202,755 (issued to Spiegelman et. al.) relates to a method of making isotropic pitch from petroleum residuum which consists of adding a low concentration of metallic sodium to the petroleum residuum and contacting said petroleum residuum with air or other oxygen source, while maintaining the temperature at about 650° F. to 750° F. for a specified period of time.

U.S. Pat. No. 4,303,631 (issued to Lewis et al) shows producing a spinnable mesophase by first heat treating and then sparging with an inert gas.

U.S. Pat. No. 4,460,454 (issued to Iijima et al) and U.S. Pat. No. 4,460,455 (issued to Moriya et al) disclose a process for producing a pitch suitable for use as a raw material for producing carbon fibers which consists of hydrogenating a petroleum residual oil in the presence of hydrogen and a hydrogenating catalyst, subjecting the resulting residual oil to solvent extraction and thermally modifying the resulting extraction component. The residual oil has a vanadium content of less than 15 ppm and a nickel content of less then 7 ppm.

U.S. Pat. No. 4,469,585 (issued to Cukier et. al.) discloses an isotropic binder pitch composition having resistance to oxidation which comprises adding a soluble alkyl-aryl sulfonic acid or salt thereof to a coal tar or petroleum pitch in the molten state. Suitable salts contain metals selected from the group consisting of groups I and II of the periodic table and ammonium.

U S. Pat. No. 4,554,148 (issued to Gomi et al) relates to a process for preparing carbon fibers which consists of subjecting a raw material oil to thermal cracking, removing cracked, light hydrocarbon components to obtain a pitch product containing 5 to 40 weight percent of mesophase containing a metal content of at least 200 ppm. Mesophase pitch is produced during the thermal cracking step in a liquid phase over a time period from about 0.3 to 10 hours.

U.S. Pat. No. 4,600,496 (issued to Cheng et. al.) relates to a process for converting isotropic pitch to mesophase pitch wherein catalytic amounts of oxides, diketones, carboxylates, and carbonyls of metals selected from vanadium, chromium, molybdenum, iron, nickel, and cobalt are added to the feed pitch. The resulting mesophase pitch is said to form carbon fibers which exhibit higher tensile strength and lower modulus value than carbon fiber produced from uncatalyzed mesophase pitch.

U.S. Pat. No. 4,664,774 (issued to Chu et al) shows a method for obtaining a coal tar pitch by oxidizing heavy oils by sparging with air, followed by stripping with an inert gas stream to remove undesirable low-boiling constituents.

U.S. Pat. No. 4,704,333 (issued to Elkins et. al.) relates to a process for the formation of carbon fibers from mesophase pitch produced from a pitch containing a catalytically effective amount of a compound selected from the group consisting of vanadium, chromium, iron, and cobalt; diketones of vanadium, chromium, and nickel; the carboxylates of nickel and cobalt; and the carbonyls of molybdenum. The compounds are present in the starting pitch in amounts from about 0.3 to about 15 weight percent.

Japanese Patent 65090 (Yamada et. al.) describes making a mesophase pitch for carbon fiber manufacture by heat treating feed in the presence of oxidizing gas at 350° to 500° C.

Koppers Co. Inc. has published Ger. Offen. DE 2,221,707 patent application, which discloses manufacture of isotropic carbon fibers wherein the starting material is first reacted with oxygen and then vacuum distilled, to remove non-oxidized lower-boiling components.

THE INVENTION

In accordance with the present invention, a pitch product containing 50 to 100 percent by volume mesophase, as determined by optical anisotropy, is obtained by contacting a carbonaceous feedstock substantially free of mesophase pitch, containing a metal alkylaryl sulfonate, with a sparging gas at an elevated temperature for a period of time, sufficient to produce a pitch product, often substantially 100 percent mesophase, having a melting point suitable for fiber spinning and resulting in fibers having excellent properties.

In one aspect of the invention, the sparging gas is an oxidative gas. In another aspect of the invention, the sparging gas is an inert gas.

DETAILED DESCRIPTION OF THE INVENTION

The carbonaceous feedstocks used in the process of the invention are heavy aromatic petroleum fractions and coal-derived heavy hydrocarbon fractions, including preferably materials designated as pitches. All of the feedstocks employed are substantially free of mesophase pitch.

The term "pitch" as used herein means petroleum pitches, natural asphalt and heavy oil obtained as a by-product in the naphtha cracking industry, pitches of high carbon content obtained from petroleum asphalt and other substances having properties of pitches produced as by-products in various industrial production processes.

The term "petroleum pitch" refers to the residuum carbonaceous material obtained from the thermal and catalytic cracking of petroleum distillates.

The term "anisotropic pitch or mesophase pitch" means pitch comprising molecules having an aromatic structure which through interaction have associated together to form optically ordered liquid crystals.

The term "isotropic pitch or amorphous pitch" means pitch comprising molecules which are not aligned in optically ordered liquid crystals.

Generally, pitches having a high degree of aromaticity are suitable for carrying out the present invention.

Carbonaceous pitches having an aromatic carbon content from about 75 percent to 90 percent as determined by nuclear magnetic resonance spectroscopy are particularly useful in the process of this invention. So, too, are high boiling, highly aromatic stream containing such pitches or that are capable of being converted into such pitches.

On a weight basis, the useful pitches will have from about 88 percent to 93 percent carbon and from about 7 percent to about 5 percent hydrogen. While elements other than carbon and hydrogen, such as sulfur and nitrogen, to mention a few, are normally present in such pitches, it is important that these other elements to not exceed about 4 percent by weight of the pitch. Also, these useful pitches typically will have an average molecular weight of the order of about 200 to 1,000.

Those petroleum pitches meeting the foregoing requirements are preferred starting materials for the practice of the present invention. Thus, it should be apparent that carbonaceous residues of petroleum origin, and particularly isotropic carbonaceous petroleum pitches which are known to form mesophase in substantial amounts, for example in the order of about 90 percent by volume and higher, during heat treatment at elevated temperatures, for example in the range of 350° C. to 450° C., are especially preferred starting materials for the practice of the present invention.

In general, any petroleum or coal-derived heavy hydrocarbon fraction may be used as the carbonaceous feedstock in the process of the invention. Suitable feedstocks in addition to petroleum pitch include heavy aromatic petroleum streams, ethylene cracker tars, coal derivatives, petroleum thermal tars, fluid catalytic cracker residues, and aromatic distillates having a boiling range from 650° to 950° F. The use of petroleum pitch-type feed is preferred.

The sulfonates which are combined with the carbonaceous feedstock are the pitch soluble, metal alkylaryl sulfonates represented by the following formulas:

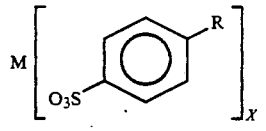

where
M is metal
X is the valence of M
R is straight or branched chain alkyl containing 2 to 20 carbon atoms.

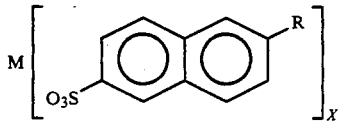

where
M is metal
X is the valence of M
R is straight chain or branched alkyl containing 2 to 20 carbon atoms.

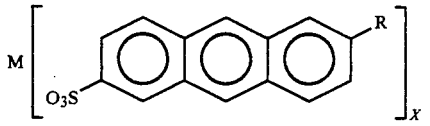

where
M is metal
X is the valence of M
R is straight chain or branched chain alkyl containing 2 to 20 carbon atoms.

Suitable sulfonates also include compounds in which more than one alkyl group is attached to the aromatic rings of the metal alkylaryl sulfonates.

The metal moiety of the alkylaryl sulfonates may generally be any metal in the periodic table; however, metals from groups V to VIII are preferred. Particularly effective metals are molybdenum, nickel, chromium, and vanadium.

Illustrative examples of metal alkylaryl sulfonates which may be used are: Vanadium hexylnaphtyl sulfonate, manganese butylbenzyl sulfonate, nickel propylanthracyl sulfonate, molybdenum octylbenzyl sulfonate, sodium nonyl benzyl sulfonate, vanadium dodecylnaphthyl sulfonate, manganese nondecylanthracyl sulfonate, magnesium undecylnaphthyl sulfonate, nickel hexadecylbenzyl sulfonate, chromium decylnaphthyl sulfonate, molybdenum tetradecylnaphthyl sulfonate, zirconium octadecylanthracyl sulfonate, titanium tridecylbenzyl sulfonate, cobalt heptadecylbenzyl sulfonate, iron pentadecylnaphthyl sulfonate, zinc octadecylanthracyl sulfonate, cadmium dodecylnaphthyl sulfonate, and aluminum hexadecylbenzyl sulfonate.

The metal alkylaryl sulfonates are incorporated in the carbonaceous feedstock in amounts effective to convert feedstock to mesophase pitch. The sulfonates may function to increase the yield of mesophase pitch product or reduce the processing time required, or both. Usually, the sulfonates are combined with the feedstock in an amount to provide from about 10 to about 120 ppm of metal in the carbonaceous feed and preferably from about 20 to about 40 ppm of metal. The amounts used will depend on the particular carbonaceous feed employed and the specific metal alkylaryl sulfonate used in the process.

When an oxidative gas is used in the process, the preferred gas is oxygen admixed with an inert gas, such as nitrogen, the mixture containing from about 0.1 to about 1.0 percent oxygen, and preferably from about 0.2 to about 0.5 percent oxygen. Gases other than oxygen such as ozone, hydrogen peroxide, nitrogen dioxide, formic acid vapor, and hydrogen chloride vapor may also be used as the oxidative component in the process. These oxidative gases are also used in admixture with various inert (non-oxidative) components. In general, there may be employed any gas stream or a mixture of various gas streams with an appropriate oxidative component having an oxidative reactivity for the mesophase forming feed equivalent to that provided by using the oxygen concentrations in the ranges disclosed.

The oxidative gas rate employed in carrying out the process is at least 0.1 SCFH per pound of feed, preferably from about 1.0 to 20 SCFH per pound. Sparging with the oxidative gas is generally carried out at atmospheric or slightly elevated pressures, e.g., about 1 to 3 atmospheres, but higher pressures may be used if desired.

In the absence of an oxidative gas, an inert gas is used as the sparging material. Suitable inert gases include such materials as nitrogen, argon, carbon dioxide, xenon, helium, methane, carbon monoxide, hydrocarbon-based flue gas, steam, and mixtures thereof. Sparging is carried out at a gas rate of at least 0.1 SCFH per pound of feedstock and preferably from about 1.0 to about 20 SCFH per pound, i.e. at the same rate as that used with an oxidative gas.

Generally the melting temperature of the mesophase pitch produced in the process is increased by the addition of the metal alkylaryl sulfonate to the carbonaceous feedstock. This is true whether the sparging gas is oxidative or inert. It is usually desirable to spin a mesophase pitch with a melting temperature below 360° C. and preferably below 340° C. Thus, the operating conditions of the process, including the treatment time, are controlled so that the mesophase pitch melting temperature is maintained at an acceptable level for spinning.

Conversion of the heat soaked carbonaceous feedstock containing metal alkylaryl sulfonate to mesophase pitch is effected by subjecting the feedstock to elevated temperatures usually at atmospheric pressure with either inert or oxidative gas sparging and with agitation as desired. The operating conditions employed include temperatures in the range of about 350° C. to about 500° C. and preferably from about 370° C. to about 425° C. The heating step is carried out over a time period from about 10 to about 30 hours and between about 16 and about 24 hours, depending on the temperature employed.

As previously pointed out, it is usually desirable to spin a mesophase pitch with a melting temperature below 360° C. and preferably below 340° C. The process of the invention produces a larger amount of mesophase pitch, having the desired melting point for spinning in a given period of time as compared to the amount of product obtained by utilizing a feedstock which does not contain metal alkylaryl sulfonate. Conversely, a desired amount of mesophase pitch product may be obtained in a much shorter period of time utilizing the process of the invention.

As compared to the use of feedstocks which do not contain alkylaryl sulfonates, the mesophase product produced in the process also is produced in a greater yield (conversion to mesophase). In addition, carbon fibers prepared from the mesophase pitch product have improved properties, i.e., higher tensile strain and improved elongation, with no adverse effect on the modulus.

The improvements of shorter reaction time and greater yield are obtained by the combination of metal alkylaryl sulfonates-carbonaceous feed in conjunction with the use of an inert sparge gas. Even more dramatic improvements are seen, including mesophase products with improved properties, when the combination feed stock is sparged with an oxidative gas; therefore, this process is the preferred process.

The heat required for the process may be provided in any conventional manner, e.g., by indirect heat exchange with hot oil, by electrical energy, or by other means.

The mesophase pitch produced in the process of the invention may be spun into continuous anisotropic carbon fibers by conventional procedures such as melt spinning, followed by the separate steps of thermosetting and carbonization. As indicated, these are known techniques, and consequently they do not constitute critical features of the present invention.

The present invention will be more fully understood by reference to the following illustrative embodiments.

EXAMPLE 1

A decant oil (850° F.+fraction) obtained from an FCC unit was used as a feedstock for the preparation of mesophase pitch. A glass reactor with a capacity of around 340 ml was used for the test and was charged with approximately 200 grams of the decant oil. Sparge gases comprising nitrogen and nitrogen containing various amounts of oxygen were charged to the reactor at a rate of 4 SCFH/pound of reactor charge. In those runs where nickel or vanadium was added to the decant oil, they were provided in the form of metal alkylaryl sulfonates. Each of the tests was carried out at a reaction temperature of 385° C. and essentially atmospheric pressure. The results of the tests are set forth in Table 1.

TABLE 1

REACTION TEMPERATURE: 385° C.
SPARGE RATE: 4 SCFH/LB FEED

| Run No. | Feed | Sparge Time (hr.) | Meso Yield (wt. %) | Hot Stage Melt Temp. (°C.) |
|---|---|---|---|---|
| | Nitrogen Sparge Gas | | | |
| 1 | Decant oil | 30 | 24.4 | 300 |
| 2 | Decant oil + sulfonate | 30 | 24.7 | 317 |
| 3 | Decant oil + 40 ppm Ni | 30 | 27.7 | 337 |
| 4 | Decant oil + 40 ppm V | 30 | 26.1 | 357 |
| 5 | Decant oil + 40 ppm V | 22 | 25.0 | 322 |
| | 0.2% Oxygen in Nitrogen Sparge Gas | | | |
| 6 | Decant oil | 32 | 27.0 | 318 |
| 7 | Decant oil + sulfonate | 32 | 25.3 | 313 |
| 8 | Decant oil + 40 ppm Ni | 21 | 29.5 | — |
| 9 | Decant oil + 40 ppm V | 21 | 29.4 | 330 |
| | 0.5% Oxygen in Nitrogen Sparge Gas | | | |
| 10 | Decant oil | 28 | 27.8 | 317 |
| 11 | Decant oil + sulfonate | 28 | 27.5 | 323 |

TABLE 1-continued

| Run No. | Feed | Sparge Time (hr.) | Meso Yield (wt. %) | Hot Stage Melt Temp. (°C.) |
|---|---|---|---|---|
| | REACTION TEMPERATURE: 385° C. SPARGE RATE: 4 SCFH/LB FEED | | | |
| 12 | Decant oil + 40 ppm Ni | 28 | 30.3 | 360 |
| 13 | Decant oil + 40 ppm V | 28 | 29.7 | 355 |
| 14 | Decant oil + 40 ppm V | 20 | 27.5 | 328 |
| | 1.0% Oxygen in Nitrogen Sparge Gas | | | |
| 15 | Decant oil | 21 | 30.5 | 319 |
| 16 | Decant oil + sulfonate | 21 | 32.8 | 323 |
| 17 | Decant oil + 40 ppm V | 21 | 31.8 | 334 |
| 18 | Decant oil + 40 ppm V | 18 | 32.2 | 315 |

The sulfonate used in runs 2, 7, 11, and 16 was a non-metallic amine sulfonate. It is noted that this sulfonate had very little effect, if any, on mesophase yield for melting point as compared to those runs where only the decant oil was used.

It should be noted that for each of the sparge gases, the presence of vanadium alkylaryl sulfonate in the feed gave a slightly greater yield of mesophase pitch and a significantly greater melting point for the same length of processing time. To obtain the same melting point, as obtained from the use of decant oil alone, it would be necessary to substantially reduce the processing time.

EXAMPLE 2

Another series of tests were carried out using the same reactor and the same operating conditions as set forth in example 1. Each of the tests, however, were carried out to provide a mesophase product having a targeted melting point of 306° C. The results of the tests are set forth in Table 2.

TABLE 2

| Run No. | Sparge Gas | Processing Time (hr) Without V | Processing Time (hr) 40 ppm V | Yields wt. % Mesophase Without V | Yields wt. % Mesophase 40 ppm V |
|---|---|---|---|---|---|
| 1 | N2 | 37 | 22.0 | 24.4 | 25.0 |
| 2 | 0.2% $O_2$ in N2 | 31 | 19.0 | 27.0 | 29.4 |
| 3 | 0.5% $O_2$ in N2 | 29 | 18.5 | 27.8 | 29.7 |
| 4 | 1.0% $O_2$ in N2 | 22 | 17.5 | 30.5 | 31.8 |

It is apparent from the data set forth in the table that the use of metal alkylaryl sulfonates in the feedstock and the combination of oxygen sparge gas with metal alkylaryl sulfonates substantially reduces the processing time required to obtain a mesophase product having a given melting point. In addition, the use of metal alkylaryl sulfonates alone and in combination with oxygen sparging also substantially increases the yield of mesophase product obtained. For example, if we compare the results obtained in run 2, the addition of 40 ppm of vanadium to the decant oil feed provided a 9 percent increase in mesophase yield. In addition, the processing time was reduced by 40 percent.

The mesophase products obtained in run 1 and in run 2 with 40 ppm vanadium were processed to obtain carbon fibers. The fibers obtained from the nitrogen sparged product had a tensile strength of 319 kpsi, an elongation of 0.8 percent and a modulus of 33 mpsi. The corresponding values for the run carried out in the presence of vanadium with oxygen sparging were 375, 1.02, and 32, respectively. It is apparent that the carbon fibers obtained with the addition of vanadium had improved tensile strength (18%) and percent elongation (28%) with no substantial effect on the modulus.

EXAMPLE 3

Another series of tests were carried out under conditions corresponding to those set forth in example 1. The results of these tests are shown in Table 3.

TABLE 3

| Run No. | Time (hrs.) | Sparge Gas | Metal | Yield (wt. %) | Percent Meso-phase | Hot Stage Melt Pt. (°C.) |
|---|---|---|---|---|---|---|
| 1 | 24 | N2 | — | 24.3 | 100 | 286 |
| 2 | 30 | N2 | — | 23.5 | 100 | 300 |
| 3 | 40 | N2 | — | 24.9 | 100 | 323 |
| 4 | 40 | N2 | — | 24.5 | 100 | 319 |
| 5 | 40 | N2 | — | 24.6 | 100 | 329 |
| 6 | 22 | N2 | 40 ppm V | 25.0 | 100 | 322 |
| 7 | 30 | N2 | 40 ppm V | 26.8 | 100 | 353 |
| 8 | 30 | N2 | 40 ppm V | 25.4 | 100 | 360 |
| 9 | 22 | N2 | 80 ppm V | 27.8 | 100 | 381 |
| 10 | 22 | N2 | 80 ppm V | 29.1 | 100 | — |
| 11 | 16 | N2 | 120 ppm V | 28.1 | 100 | 445 |
| 12 | 30 | N2 | 40 ppm Ni | 28.6 | 100 | 334 |
| 13 | 30 | N2 | 40 ppm Ni | 26.9 | 100 | 340 |

It is noted from the table that the use of vanadium and nickel in the decant feed produced improved yields and gave substantially higher melting points of the mesophase product. Thus to obtain the same melting point as in those runs without the added metal, it would be possible to substantially reduce the reaction time. It is further noted that all of the runs produced 100 percent mesophase product.

EXAMPLE 4

Another series of runs were made utilizing the procedure set forth in example 1. In these runs, additional metal alkylaryl sulfonates were tested. The results of these tests are set forth in Table 4.

TABLE 4

| Run No. | Time (hrs.) | Sparge Gas | Metal | Yield (wt. %) | Percent Meso-phase | Hot Stage Melt Pt. (°C.) |
|---|---|---|---|---|---|---|
| 1 | 20 | N2 | — | 20.3 | 92 | 287 |
| 2 | 20 | N2 | — | 17.8 | 86 | 279 |
| 3 | 22 | N2 | — | 18.9 | 100 | 285 |
| 4 | 22 | N2 | — | 18.3 | 100 | 284 |
| 5 | 24 | N2 | — | 17.0 | 100 | 297 |
| 6 | 24 | N2 | — | 16.9 | 100 | 296 |
| 7 | 28 | N2 | — | 16.7 | 100 | 298 |
| 8 | 28 | N2 | — | 17.5 | 100 | 296 |
| 9 | 32 | N2 | — | 17.1 | 100 | 308 |
| 10 | 32 | N2 | — | 16.7 | 100 | 308 |
| 11 | 16 | N2 | 40 ppm V | 19.9 | 81 | 289 |
| 12 | 16 | N2 | 40 ppm V | 20.8 | 62 | 297 |
| 13 | 20 | N2 | 40 ppm V | 19.8 | 100 | 325 |
| 14 | 20 | N2 | 40 ppm V | 19.6 | 100 | 337 |
| 15 | 25.5 | N2 | 40 ppm V | 18.3 | 100 | 367 |
| 16 | 25.5 | N2 | 40 ppm V | 17.8 | 100 | 363 |
| 17 | 24 | N2 | 40 ppm Cu | 20.2 | 100 | 299 |
| 18 | 24 | N2 | 40 ppm Cu | 17.1 | 100 | 298 |
| 19 | 24 | N2 | 40 ppm Fe | 18.1 | 100 | 297 |
| 20 | 24 | N2 | 40 ppm Fe | 17.8 | 100 | 297 |
| 21 | 24 | N2 | 40 ppm Ni | 19.5 | 100 | 328 |
| 22 | 24 | N2 | 40 ppm Ni | 18.0 | 100 | 326 |
| 23 | 24 | N2 | 40 ppm Cr | 19.6 | 100 | 347 |
| 24 | 24 | N2 | 40 ppm Cr | 18.7 | 100 | 345 |
| 25 | 24 | N2 | 40 ppm Mo | 21.7 | 100 | 358 |
| 26 | 24 | N2 | 40 ppm Mo | 20.5 | 100 | 363 |
| 27 | 19 | 0.2% $O_2$ | 40 ppm Cu | 21.4 | 93 | 287 |

TABLE 4-continued

| Run No. | Time (hrs.) | Sparge Gas | Metal | Yield (wt. %) | Percent Mesophase | Hot Stage Melt Pt. (°C.) |
|---|---|---|---|---|---|---|
| 28 | 19 | 0.2% $O_2$ | 40 ppm Cu | 21.7 | 92 | 283 |
| 29 | 19 | 0.2% $O_2$ | 40 ppm Cr | 22.2 | 95 | 285 |
| 30 | 19 | 0.2% $O_2$ | 40 ppm Cr | 20.7 | 96 | 288 |
| 31 | 19 | 0.2% $O_2$ | 40 ppm Ni | 22.4 | 98 | 302 |
| 32 | 19 | 0.2% $O_2$ | 40 ppm Ni | 21.0 | 97 | 304 |
| 33 | 19 | 0.2% $O_2$ | 40 ppm V | 19.6 | 98 | 334 |
| 34 | 19 | 0.2% $O_2$ | 40 ppm V | 19.8 | 98 | 335 |
| 35 | 19 | 0.2% $O_2$ | 40 ppm Mo | 22.8 | 100 | 333 |
| 36 | 19 | 0.2% $O_2$ | 40 ppm Mo | 22.6 | 100 | 334 |

It is noted that all of the metals used provided at least modest improvements, and in the case of chromium, vanadium, and molybdenum, the improvement in yields and melting point increases were substantial. It should be noted further that as the processing time dropped below 20 hours, there was a reduction in the percent mesophase contained in the product.

EXAMPLE 5

Another series of runs were carried out utilizing the procedure of example 1. In each of these runs, the process was continued for a sufficient period of time to obtain a targeted melting point of the mesophase of 300° C.

TABLE 5

| Run No. | Type of Run | Processing Time (hr.) | Yield (wt. %) | Production Increase per hour (%) |
|---|---|---|---|---|
| 1 | N2 Sparge | 33 | 17 | |
| 2 | 40 ppm Ni in Feed with N2 Sparge | 24 | 18.8 | 44 |
| 3 | 0.2% $O_2$ in N2 Sparge | 28.5 | 19.6 | |
| 4 | 40 ppm Ni in Feed with 0.2% $O_2$ in N2 Sparge | 19 | 21.7 | 67 |

If we compare runs 1 and 2, taking into account both the processing time and yield changes, run 2 with the nickel addition to the feed shows a production increase of 44 percent per hour. A similar comparison of runs 3 and 4 shows a production increase with nickel addition of 67 percent per hour.

While certain embodiments and details have been shown for the purpose of illustrating the present invention, it will be apparent to those skilled in the art the various changes and modifications may be made herein without departing from the spirit or scope of the invention.

I claim:

1. A process which comprises heating a carbonaceous heavy aromatic and/or heavy hydrocarbon feedstock substantially free of mesophase pitch, containing an amount of a metal alkylaryl sulfonate, which provides at least 10 ppm metal to the feedstock where the metal is any metal from Group I through VIII of the Periodic Table capable of complexing with alkylaryl sulfonates, wherein said heating of said feedstock takes place in the presence of a sparging gas for a period of time sufficient to obtain a mesophase pitch suitable for carbon fiber manufacture.

2. The process of claim 1 in which the sparging gas is an oxidative gas.

3. The process of claim 2 in which the oxidative gas is selected from the group consisting of oxygen, ozone, hydrogen peroxide, nitrogen dioxide, formic acid vapor, hydrogen chloride vapor, and mixtures thereof.

4. The process of claim 3 in which the oxidative gas is a mixture of oxygen and inert gas.

5. The process of claim 4 in which the carbonaceous feedstock is a pitch.

6. The process of claim 5 in which the feedstock is a petroleum pitch.

7. The process of claim 1 in which the sparging as is an inert gas.

8. The process of claim 1 in which the metal alkylaryl sulfonate is present in an amount to provide from about 10 to about 120 ppm of metal in the carbonaceous feed.

9. The process of claim 1 wherein the alkylaryl metal sulfonate contains molybdenum, nickel, chromium, or vanadium.

10. A process for producing a mesophase pitch suitable for carbon fiber manufacture which comprises heating a heavy aromatic and/or heavy hydrocarbon feedstock substantially free of mesophase pitch containing an amount of a metal alkylaryl sulfonate which provides at least 10 ppm metal to the feedstock where the metal is any metal from Group I through VIII of the Periodic Table capable of complexing with alkylaryl sulfonates, wherein the heating of said feedstock is in the presence of an oxidative sparging gas at a temperature between about 350° C. and about 500° C. and a sparging gas rate from about 1.0 to about 20 SCFH per pound of feedstock for a period of time sufficient to obtain a mesophase pitch suitable for carbon fiber manufacture.

11. The process of claim 10 in which the process is carried out for a time period of about 10 to about 30 hours.

12. The process of claim 11 in which the oxidative gas is selected from the group consisting of oxygen, ozone, hydrogen peroxide, nitrogen dioxide, formic acid vapor, hydrogen chloride vapor, and mixtures thereof.

13. The process of claim 12 in which the oxidative gas is a mixture of oxygen and inert gas in which the oxygen content is between about 0.1 to about 1.0 percent.

14. The process of claim 13 in which the inert gas is nitrogen.

15. The process of claim 10 in which the metal alkylaryl sulfonate is present in an amount to provide from about 10 to about 120 ppm of metal in the carbonaceous feed.

16. The process of claim 1 wherein the alkylaryl sulfonate contains metal from Groups V through Group VIII of the periodic table.

17. The process of claim 10 wherein the alkylaryl sulfonate contains metals from Groups V through Group VIII of the periodic table.

18. The process of claim 10 wherein the alkylaryl metal sulfonate contains molybdenum, nickel, chromium, or vanadium.

19. A process for producing a mesophase pitch suitable for carbon fiber manufacture which comprises heating a heavy aromatic and/or heavy hydrocarbon feedstock substantially free of mesophase pitch containing an amount of a metal alkylaryl sulfonate which provides at least 10 ppm metal to the feedstock where the metal is any metal from Group I through VIII of the Periodic Table capable of complexing with alkylaryl sulfonates in the presence of an inert sparging gas at a temperature between about 350° C. and about 500° C.

and a sparging gas rate from about 1.0 to about 20 SCFH per pound of feedstock for a period of time sufficient to obtain a mesophase pitch suitable for carbon fiber manufacture.

20. The process of claim 19 in which the process is carried out for a time period of about 10 to about 30 hours.

21. The process of claim 20 in which the inert gas is selected from the group consisting of nitrogen, argon, carbon dioxide, xenon, helium, methane, carbon dioxide, hydrocarbon-based flue gas, steam, and mixtures thereof.

22. The process of claim 21 in which the inert gas is nitrogen.

23. The process of claim 19 in which the metal alkylaryl sulfonate is present in an amount to provide from about 10 to about 120 ppm of metal in the carbonaceous feed.

24. The process of claim 19 wherein the alkylaryl sulfonate contains metals from Groups V through Group VIII of the periodic table.

25. The process of claim 19 wherein the alkylaryl metal sulfonate contains molybdenum, nickel, chromium, or vanadium.

* * * * *